US008847054B2

(12) United States Patent
Aiylam

(10) Patent No.: US 8,847,054 B2
(45) Date of Patent: Sep. 30, 2014

(54) GENERATING A SYNTHESIZED MELODY

(71) Applicant: Dhroova Aiylam, Shrewsbury, MA (US)

(72) Inventor: Dhroova Aiylam, Shrewsbury, MA (US)

( * ) Notice: Subject to any disclaimer, the term of this patent is extended or adjusted under 35 U.S.C. 154(b) by 0 days.

(21) Appl. No.: 13/887,076

(22) Filed: May 3, 2013

(65) Prior Publication Data

US 2014/0208924 A1 Jul. 31, 2014

Related U.S. Application Data

(60) Provisional application No. 61/759,005, filed on Jan. 31, 2013.

(51) Int. Cl.
*G10H 1/26* (2006.01)

(52) U.S. Cl.
USPC ..... 84/609; 84/613; 84/649; 84/650

(58) Field of Classification Search
USPC ..... 84/609, 613, 649, 650
See application file for complete search history.

(56) References Cited

U.S. PATENT DOCUMENTS

| | | | | | |
|---|---|---|---|---|---|
| 4,926,737 | A | * | 5/1990 | Minamitaka | 84/611 |
| 4,982,642 | A | | 1/1991 | Nishikawa et al. | 84/484 |
| 5,179,240 | A | * | 1/1993 | Mizuno et al. | 84/613 |
| 5,200,566 | A | * | 4/1993 | Shimaya | 84/609 |
| 5,218,153 | A | * | 6/1993 | Minamitaka | 84/613 |
| 5,278,348 | A | * | 1/1994 | Eitaki et al. | 84/636 |
| 5,281,754 | A | * | 1/1994 | Farrett et al. | 84/609 |
| 5,375,501 | A | * | 12/1994 | Okuda | 84/611 |
| 5,418,322 | A | * | 5/1995 | Minamitaka | 84/609 |
| 5,451,709 | A | * | 9/1995 | Minamitaka | 84/609 |
| 5,627,335 | A | * | 5/1997 | Rigopulos et al. | 84/635 |
| 5,663,517 | A | * | 9/1997 | Oppenheim | 84/649 |
| 5,760,325 | A | * | 6/1998 | Aoki | 84/613 |
| 5,859,379 | A | * | 1/1999 | Ichikawa | 84/609 |
| 5,990,407 | A | * | 11/1999 | Gannon | 84/613 |
| 6,100,462 | A | * | 8/2000 | Aoki | 84/613 |
| 6,124,543 | A | * | 9/2000 | Aoki | 84/609 |
| 6,194,647 | B1 | * | 2/2001 | Tateno | 84/609 |
| 6,255,577 | B1 | * | 7/2001 | Imai | 84/609 |
| 6,294,720 | B1 | * | 9/2001 | Aoki | 84/611 |
| 6,392,134 | B2 | * | 5/2002 | Aoki | 84/609 |
| 6,395,970 | B2 | * | 5/2002 | Aoki | 84/613 |

(Continued)

FOREIGN PATENT DOCUMENTS

EP 1265221 A1 * 12/2002 ..... G10H 1/00

OTHER PUBLICATIONS

Laird Baird. Charlie Parker, performed 1956, transcribed by Jamey Aebersold in "Charlie Parker Omnibook" Published by Atlantic Music Corp. in 1978.*

(Continued)

*Primary Examiner* — David S. Warren
(74) *Attorney, Agent, or Firm* — Fish & Richardson P.C.

(57) ABSTRACT

A method performed by one or more processing devices includes receiving information indicative of an input chord progression, with the input chord progression comprising a plurality of chords; identifying chord changes in the plurality of chords; identifying, based on the chord changes, moving tones in the input chord progression; selecting, from the moving tones, guide tones that provide an outline of a harmony to be used in generating a synthesized melody; generating, based on the selected guide tones and one or more interpolation operations, interpolation tones for interpolation among the guide tones; and generating, based on interpolation of the interpolation tones with the guide tones, the synthesized melody.

20 Claims, 7 Drawing Sheets

(56) References Cited

U.S. PATENT DOCUMENTS

| | | | | |
|---|---|---|---|---|
| 6,403,870 | B2 * | 6/2002 | Aoki | 84/609 |
| 6,486,390 | B2 * | 11/2002 | Aoki et al. | 84/611 |
| 6,506,969 | B1 * | 1/2003 | Baron | 84/609 |
| 6,867,358 | B1 * | 3/2005 | Mester, Jr. | 84/609 |
| 6,965,069 | B2 * | 11/2005 | Le-Faucheur et al. | 84/659 |
| 7,034,217 | B2 * | 4/2006 | Pachet | 84/609 |
| 7,053,291 | B1 * | 5/2006 | Villa | 84/609 |
| 7,435,891 | B2 * | 10/2008 | Perla | 84/470 R |
| 7,671,267 | B2 * | 3/2010 | Hillborg | 84/609 |
| 7,825,320 | B2 * | 11/2010 | Yatsui | 84/613 |
| 7,960,638 | B2 * | 6/2011 | Miyajima et al. | 84/604 |
| 8,097,801 | B2 * | 1/2012 | Gannon | 84/613 |
| RE43,379 | E * | 5/2012 | Suzuki et al. | 84/600 |
| 8,487,176 | B1 * | 7/2013 | Wieder | 84/615 |
| 8,581,085 | B2 * | 11/2013 | Gannon | 84/613 |
| 2001/0020412 | A1 * | 9/2001 | Aoki et al. | 84/611 |
| 2001/0045154 | A1 * | 11/2001 | Aoki | 84/609 |
| 2002/0007721 | A1 * | 1/2002 | Aoki | 84/613 |
| 2002/0011145 | A1 * | 1/2002 | Aoki | 84/609 |
| 2002/0177997 | A1 * | 11/2002 | Le-Faucheur et al. | 704/208 |
| 2006/0075881 | A1 * | 4/2006 | Streitenberger et al. | 84/609 |
| 2008/0289480 | A1 * | 11/2008 | Yatsui | 84/613 |
| 2009/0025540 | A1 * | 1/2009 | Hillborg | 84/609 |
| 2012/0269344 | A1 * | 10/2012 | VanBuskirk | 380/255 |
| 2013/0125732 | A1 * | 5/2013 | Nguyen | 84/609 |

OTHER PUBLICATIONS

Chen, "Compuuter Improvisation of Jazz Solos". 1992, retrieved Oct. 3, 2011 from https://titdml.rit.edu/bitstream/handle/1850/11088/DChenThesis07-13-1992.pdf.sequence=1.

Franz, Markov Chains As Tools for Jazz improvisation, 1998, retrieved Oct. 31, 2011 from http://scholar.lib.vt.edu/theses/available/etd-61098-131249/unrestricted/dmfetd.pdf.

Introduction to Jazz (n.d.) retrieved Oct. 15, 2011 from http://jazz.about.com/.

Introduction to Music Theory (n.d.) retrieved Oct. 18, 2011 from http://www.8notes.com/theory/.

Kays and Intervals (n.d.) retrieved Oct. 28, 2011 from http://library.thinkquest.org/15413/theory/intervals.html.

Koelle, "The Complete Guide to JFugue Programming Music in Java", 2008, retrieved from http://www.jfugue.org.

Popular Chord Changes (n.d.) retrieved Oct. 13, 2011 from http://www.guitar-chord-theory.com/images/chordprog2.jpg.

* cited by examiner

GENERATING A SYNTHESIZED MELODY

CLAIM OF PRIORITY

This application claims priority under 35 U.S.C. §119(e) to provisional U.S. Patent Application 61/759,005, filed on Jan. 31, 2013, the entire contents of which are hereby incorporated by reference.

BACKGROUND

Algorithmic composition is a technique of using algorithms to generate music. Various types of algorithms may be used in the generation of music, including, stochastic algorithms. Generally, a stochastic algorithm includes a process that uses a collection of random variables to generate a random value. There are various types of stochastic algorithms, including, e.g., Markov chains and Gaussian distributions.

SUMMARY

In one aspect of the present disclosure, a method performed by one or more processing devices includes receiving information indicative of an input chord progression, with the input chord progression comprising a plurality of chords; identifying chord changes in the plurality of chords; identifying, based on the chord changes, moving tones in the input chord progression; selecting, from the moving tones, guide tones that provide an outline of a harmony to be used in generating a synthesized melody; generating, based on the selected guide tones and one or more interpolation operations, interpolation tones for interpolation among the guide tones; and generating, based on interpolation of the interpolation tones with the guide tones, the synthesized melody.

Implementations of the disclosure can include one or more of the following features. In some implementations, generating the interpolation tones for interpolation among the guide tones comprises: generating, for a particular chord in the input chord progression, one or more interpolation tones for the particular chord in the input chord progression; and wherein the one or more interpolation tones generated for the particular chord are consonant with original tones included the particular chord. In other implementations, the method includes identifying harmonic attributes of the chord progression; wherein selecting, from the moving tones, the guide tones comprises: selecting, from the moving tones, the guide tones; and selecting, from the harmonic attributes, guide attributes; and wherein generating, based on the interpolation of the interpolation tones with the guide tones, the synthesized melody comprises: generating, based on interpolation of the interpolation tones with the guide tones and based on one or more of the guide attributes, the synthesized melody.

In other implementations, the harmonic attributes comprise one or more of scale degrees and types of the plurality of chords in the chord progression and detected tension in the plurality of chords in the chord progression. In still other implementations, the input chord progression is for jazz music. In some implementations, the method includes applying one or more interpolation operations to the guide tones; wherein generating, based on the selected guide tones, the interpolation tones for interpolation among the guide tones comprises: generating, based on applying the one or more interpolation operations to the guide tones, the interpolation tones for interpolation among the guide tones. In still other implementations, the one or more interpolation operations comprise one or more of a tone based interpolation operation, a harmonic based interpolation operation, a chord based interpolation operation, and a scale based interpolation operation.

In some implementations, the method includes retrieving a plurality of musical rules that promote melodious musical quality; applying the plurality of musical rules to attributes of the synthesized melody; determining, based on applying, a quality level value of the synthesized melody; and determining that the quality level value of the synthesized melody satisfies a quality threshold value.

In still another aspect of the disclosure, one or more machine-readable media are configured to store instructions that are executable by one or more processing devices to perform operations including receiving information indicative of an input chord progression, with the input chord progression comprising a plurality of chords; identifying chord changes in the plurality of chords; identifying, based on the chord changes, moving tones in the input chord progression; selecting, from the moving tones, guide tones that provide an outline of a harmony to be used in generating a synthesized melody; generating, based on the selected guide tones and one or more interpolation operations, interpolation tones for interpolation among the guide tones; and generating, based on interpolation of the interpolation tones with the guide tones, the synthesized melody. Implementations of this aspect of the present disclosure can include one or more of the foregoing features.

In still another aspect of the disclosure, an electronic system includes one or more processing devices; and one or more machine-readable media configured to store instructions that are executable by the one or more processing devices to perform operations including: receiving information indicative of an input chord progression, with the input chord progression comprising a plurality of chords; identifying chord changes in the plurality of chords; identifying, based on the chord changes, moving tones in the input chord progression; selecting, from the moving tones, guide tones that provide an outline of a harmony to be used in generating a synthesized melody; generating, based on the selected guide tones and one or more interpolation operations, interpolation tones for interpolation among the guide tones; and generating, based on interpolation of the interpolation tones with the guide tones, the synthesized melody. Implementations of this aspect of the present disclosure can include one or more of the foregoing features.

All or part of the foregoing can be implemented as a computer program product including instructions that are stored on one or more non-transitory machine-readable storage media, and that are executable on one or more processing devices. All or part of the foregoing can be implemented as an apparatus, method, or electronic system that can include one or more processing devices and memory to store executable instructions to implement the stated functions.

The details of one or more implementations are set forth in the accompanying drawings and the description below. Various advantages are associated with the techniques described herein. For example, generated music outlines an input harmony (e.g., an input chord progression). A user interface for implementing these techniques promotes user manageability. The generated music sounds harmonious over various (e.g., specified) chord changes. Also the generated music is distinct and varied over time. Other features, objects, and advantages will be apparent from the description and drawings, and from the claims.

DETAILED DESCRIPTION

Figure 1:
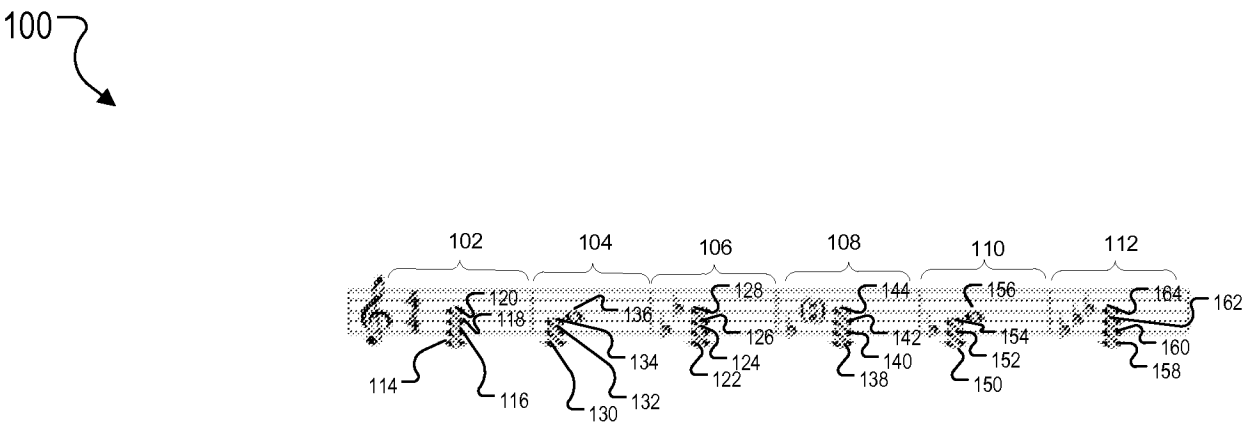
FIGS. 1-3 illustrate examples of chords.

A system consistent with this disclosure improvises over and performs harmonic analysis on music (e.g., jazz music). In an example, music includes a chord progression. Generally, a chord progression includes a series of chords that are concatenated together. Generally, a chord includes a collection of notes of a specific degree in a scale. Generally, a note includes a symbol for a tone that indicates pitch of the tone by a position on a staff and duration of the tone by a shape of the note. Generally, a scale includes a series of notes differing in pitch according to a specific scheme (e.g., within an octave). Generally, a degree in a scale includes a name of a particular note of a scale in relation to a tonic (e.g., a note of the scale that is considered the most important, relative to importance of other notes in the scale). In an example, the tonic is considered to be the first degree of the scale. For example, the major chord is built on the root ($1^{st}$ tone), $3^{rd}$ (tone) and $5^{th}$ of the major scale. The C major chord comprises the notes C, E, G. The minor chord is built on the root, $3^{rd}$ and $5^{th}$ of the minor scale. The C minor chord comprises the notes C, Eb, G.

In an example, the system performs harmonic analysis on an input chord progression, e.g., a chord progression that is input into the system. Based on the harmonic analysis, the system identifies moving tones in the chord changes for the input chord progression. Generally, a moving tone includes a note whose motion characterizes a particular chord change in the progression. Generally, a chord change includes a progression from one chord to another chord and may occur on an accented beat, so that chord changes may contribute to rhythm, meter and musical form of a chord progression. From the moving tones, the system selects guide tones. Generally, a guide tone includes a tone that is used in generation of synthesized music. Using the selected guide tones, the system interpolates music through these guide tones. In an example, the interpolated music includes interpolation tones, e.g., notes for interpolation among the guide tones. In an example, interpolation tones are other notes to be inserted between guide tones. For example, the interpolation tones may include discrete tones and/or scale notes e.g., based on tensions detected in the input chord and results of the harmonic analysis on the input chord progression. Tensions are an attribute of the chord, not the progression. In an example, for each chord in the input chord progression, the system generates interpolation tones that are a function of the guide tones, e.g., based on one or more guide tones for the chord. In this example, the system generates interpolation tones that are consonant with the corresponding chords.

By interpolating between the guide tones with the interpolation tones, the system generates a synthesized melody. The synthesized melody differs from the input chord progression and sounds harmonious and reflects attributes of the input chord progression. In an example, the input chord progression differs from an output chord progression. In an example, the system confirms the quality of the synthesized melody by comparing attributes of the synthesized melody to various musical rules. Generally, an attribute includes a quality and/or a characteristic. Generally, a musical rule includes an instruction for determining whether an attribute of a melody or chord progression promotes various criteria for evaluating music, e.g., melodious harmony and so forth.

Referring to FIG. 1, chord progression 100 includes chords 102, 104, 106, 108, 110, 112. In this example, each of chords 102, 104, 106, 108, 110, 112 include various notes. In the example of FIG. 1, each of chords 102, 104, 106, 108, 110, 112 is a four note chord. For example, chord 102 includes notes 114, 116, 118, 120. Chord 104 includes notes 130, 132, 134, 136. Chord 106 includes notes 122, 124, 126, 128. Chord 108 includes notes 138, 140, 142, 144. Chord 110 includes notes 150, 152, 154, 156. Chord 112 includes notes 158, 160, 162, 164. In this example, chord progression 100 is an input chord progression that is used by the above-described system in generating a synthesized melody.

Figure 2:
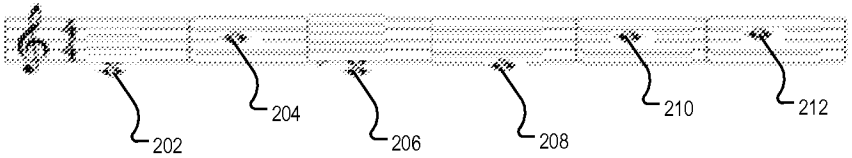

From the notes in chords 102, 104, 106, 108, 110, 112 of chord progression 100, various guide notes are selected. Generally, a guide note includes a visualization of a guide tone, e.g., a symbol that represents a guide tone. Referring to FIG. 2, guide notes 202, 204, 206, 208, 210, 212 are selected. In this example, guide notes 202, 204, 206, 208, 210, 212 are the same as notes 114, 130, 122, 138, 150, 158, respectively.

Figure 3:
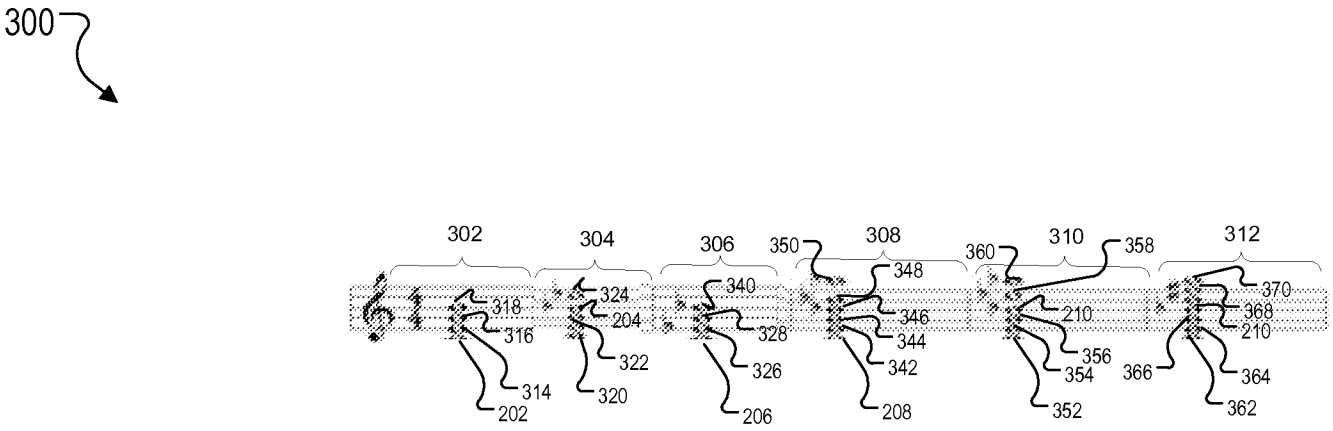

Referring to FIG. 3, synthesized melody 300 is generated using guide notes 202, 204, 206, 208, 210, 212. Synthesized melody 300 includes guide notes 202, 204, 206, 208, 210, 212 and interpolation notes 314, 316, 318, 320, 322, 324, 326, 328, 330, 332, 334, 336, 338, 340, 342, 344, 346, 348, 350, 352, 354, 356, 358, 360, 362, 364, 366, 368, 370. Synthesized melody 300 includes chords 302, 304, 306, 308, 310, 312. For chord 302, one or more of guide notes 202, 204, 206, 208, 210, 212 are used in generating interpolation notes 314, 316, 318 and interpolating interpolation notes 314, 316, 318 relative to one or more of guide notes 202, 204, 206, 208, 210, 212. Interpolation notes 314, 316, 318, 320, 322, 324, 326, 328, 330, 332, 334, 336, 338, 340, 342, 344, 346, 348, 350, 352, 354, 356, 358, 360, 362, 364, 366, 368, 370 are interpolated with guide notes 202, 204, 206, 208, 210, 212 by determining a placement of the interpolation notes relative to guide notes and inserting these interpolation notes into chord progression 300 in accordance with the determined placement, as described in further detail below.

Figure 4:
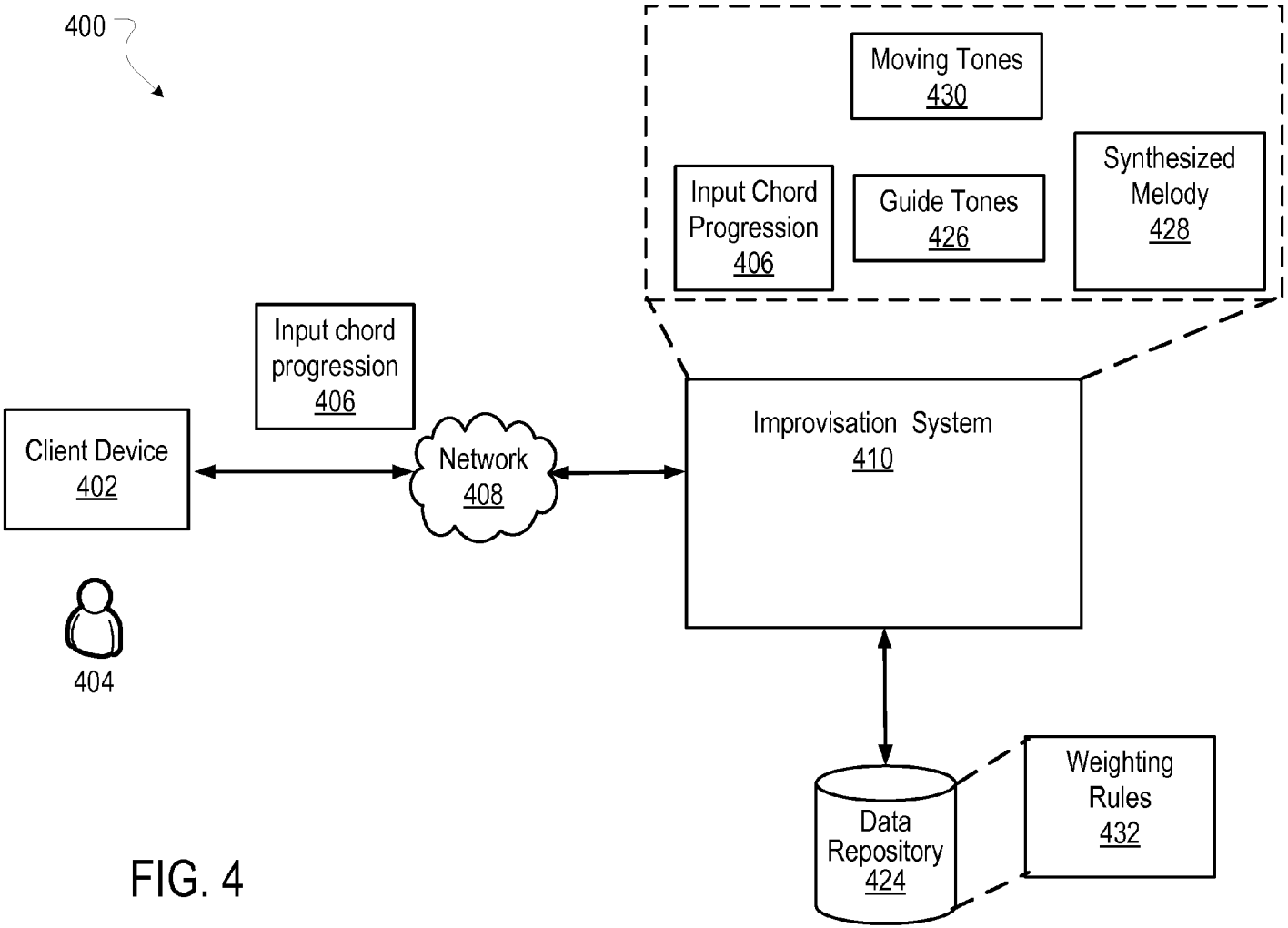
FIG. 4 is a block diagram of an example of a network environment for generating a synthesized melody.

Referring to FIG. 4, network environment 400 includes client device 402, network 408, improvisation system 410, and data repository 424. Network environment 400 may include many thousands of data repositories, client devices, and improvisation systems, which are not shown.

In the example of FIG. 4, client device 402 is associated with user 404. In this example, user 404 uses client device 402 to select input chord progression 406. Following the selection, client device 402 transmits input chord progression 406 (and/or information indicative of input chord progression 406) to improvisation system 410. Input chord progression 406 and information indicative of input chord progression 406 may collectively be referred to as input chord progression 406, for purposes of convenience, and without limitation. Client device 402 also transmits, to improvisation system 410, a request to use input chord progression 406 in music synthesis, e.g., by generating synthesized melody 428.

In an example, improvisation system 410 is configured to detect, in input chord progression, various musical elements, including, e.g., chords, notes, keys, scales, and so forth. In this example, improvisation system 410 detects various chord changes in input chord progression 406. In an example, improvisation system 410 represents the various chord changes as a string of information, e.g., as a JFugue string (as described in further detail below). In this example, improvisation system 410 also detects a key of the input chord progression 406. Changes in chord and key are passed as input to improvisation system 410. Using the key and chord changes, improvisation system 410 performs harmonic analysis on input chord progression 406. In performing harmonic analysis, improvisation system 410 identifies attributes of input chord progression 406 and moving tones 430 of the various chord changes. In an example, input chord progression 406 includes a set of tones. In this example, moving tones 430 includes a subset of the tones in the set of tones in input chord progression 406. In an example, improvisation system 410 identifies moving tones 430 by comparing consecutive chord changes that are present in input chord progression 406. When a pair of consecutive chords is voiced, several of the notes remain the same while other move slightly; these are the moving tones. In this example, improvisation system 410 uses moving tones 430 to determine how to voice chords with the left hand. Voicing a chord is choosing an arrangement of its notes (possibly including tensions) to play. Improvisation system 410 also uses moving tones 430 in selecting guide tones 426. As described in further detail below, guide tones 426 provide an outline of a harmony to be used by improvisation system 410 in generating synthesized melody 428.

During harmonic analysis, improvisation system 410 also identifies various types of attributes of input chord progression 406. Attributes include the scale degrees and chord types of the chords in progression 406. Improvisation system 410 identifies the scale degrees from the key of input chord progression 406. Scale degrees are identified from the key as follows. Within a given key, a note (and thus the root notes of the chords) have a corresponding scale degree. Based on the harmonic analysis, improvisation system 410 identifies the chords used in input chord progression 406, scales that are harmonious over the chords used in input chord progression 406, and the key of input chord progression 406.

Based on results of the harmonic analysis, improvisation system 410 identifies guide tones 426, e.g., from moving tones 430 included in input chord progression 406. In an example, guide tones 426 include a subset of a set of tones included in moving tones 430.

Using guide tones 426, improvisation system 410 synthesizes music that reflects the harmonic analysis. In an example, improvisation system 410 generates synthesized melody 428, which includes synthesized music that reflects the harmonic analysis of input chord progression 406.

In the example of FIG. 4, improvisation system 410 interpolates lines through guide tones 426. The line is the melodic line (sequence of notes) that the system generates. In an example, interpolating among lines includes a process of fitting a series of appropriate notes between two guide tones. The lines serve as a synthesized melody outline for synthesized melody 428. Using guide tones 426 and the interpolated lines, improvisation system 410 executes interpolation operations to generate interpolation tones. Generally, an interpolation operation includes a series of instructions for generation of an interpolation tone. Generally, an interpolation tone includes a tone that is at least partly based on a guide tone and that is interpolated between guide tones. Interpolation tones are used to musically connect guide tones. Improvisation system 410 executes various types of interpolation operations, including, e.g., a tone based interpolation operation, a chromatic interpolation operation, a chord based interpolation operation, a scale based interpolation operation, and so forth. Generally, a tone based interpolation operation includes an interpolation operation, which selects interpolation tones from chord tones and chord tensions of a particular chord in the progression.

For example, improvisation system 410 may execute a tone based interpolation operation that generates an interpolation tone by using chord tones and/or tensions to connect consecutive guide tones included in a particular chord and/or included in a series of chords. In this example, the guide tones are connected by choosing some set of intermediary chord tones and tensions. In another example, interpolation system 410 may execute a tone based interpolation operation that selects the guide tones at random and based on a closeness (e.g., a proximity) of the guide tones to each other. In an example, the proximity of guide tones to each other is indicative of how musically relevant the guide tones are to a particular chord in input chord progression 406. The generated interpolation tones include chord tones and/or available tensions in chords of input chord progression 406.

Generally, a chord based interpolation operation builds intervals and triads from chord and scale notes. In this example, improvisation system 410 uses guide tones 426 in building triads on a chord scale of one of the chords in input chord progression 406. Generally, a triad includes a chord of three tones. For example, improvisation system 410 selects a plurality of guide tones 426 (e.g., three of guide tones 426), e.g., in a particular chord or among a series of chords. Using the guide tones, improvisation system 410 builds the triad by chromatically connecting the selected guide tones. Triads are built from a single guide note; the other notes of the triad are chosen from the chord scale. In this example, the chord based interpolation operation is used to give a fuller sound to a synthesized melody. Generally, a scale based interpolation operation includes an interpolation operation of generating interpolation notes by connecting guide tones using scales that are harmonious over a chord. In an example, the guide tones are specific tones in a chord (e.g., a chord of input chord progression 406) and are included in a chord scale and in other functional scales. Interpolation system 410 splits the chord scale into constituent tones, randomly rearranges the tones, and connects the tones to each other to generate a phrase (e.g., a series) of interpolation tones.

Generally, a chromatic interpolation operation includes an interpolation operation for generating an interpolation note for placement between guide tones. In this example, improvisation system 410 selects as the interpolation note a note that may be played in phrase with the guide tones for a particular chord. In an example, improvisation system 410 selects the chromatic interpolation operation when intervals among guide tones in a chord are small, e.g., relative to intervals among other guide tones in other chords. Based on the size of the interval between guide tones, different methods are used to interpolate harmonically. Methods for interpolation include the use of the chord scale, chromatic (stepwise) motion, chord tensions, and triads/intervals built from the chord scale.

In an example, improvisation system 410 selects interpolation operations (from a set of interpolation operations) by applying weighting rules 432 to the various interpolation operations. Generally, weighting rules 432 are stored in data repository 424 and include a set of instructions for assigning a weighted value to an interpolation operation tone. Generally, a weighted value ("weight") includes information specifying an importance of one type of information relative to the importance of other types of information.

In an example, interpolation operations include interpolation operation 1, interpolation operation 2, interpolation operation 3, interpolation operation 4, and interpolation operation 5. In this example, weighting rules 432 include an assignment of weights to the interpolation operations, as shown in the below Table 1.

TABLE 1

| Interpolation operation | Weight |
|---|---|
| Interpolation operation 1 | 50% |
| Interpolation operations 2 and 3 | 30% |
| Interpolation operations 4 and 5 | 20% |

The weights in the above Table 1 specify a percentage of the time in which particular interpolation operations are selected for use in generation interpolation tones, e.g., out of a predefined number of times that improvisation system 410 selects interpolation operations. For example, as shown in the above Table 1, interpolation operation 1 is assigned a weight that specifies that interpolation operation 1 should be selected fifty percent of the times that synthesizer system 410 selects interpolation operations. Interpolation operations 2 and 3 are assigned weights that specify that interpolation operation 2 and/or interpolation operation 3 should be selected thirty percent of the times that improvisation system 410 selects interpolation operations. Interpolation operations 4 and 5 are assigned weights that specify that interpolation operation 4 and/or interpolation operation 5 should be selected twenty percent of the times that improvisation system 410 selects interpolation operations.

In an example, improvisation system 410 executes weighting rules 432 to assign weights to interpolation operations. In this example, weights are assigned to interpolation operations in accordance with weighting rules 432, as specified in Table 1. Based on the various weights assigned to interpolation operations, improvisation system 410 selects an interpolation operation for use in generating an interpolation tone. A particular interpolation operation is selected in accordance with the weights assigned to the interpolation operations, e.g., to promote a selection of interpolation operations that is in accordance with the percentages specified in Table 1.

In an example, improvisation system 410 reserves portions of synthesized melody 428 for rests and articulation. Generally, articulation includes a musical direction performance technique that affects the transition or continuity on a single note or between multiple notes or sounds. There are many types of articulation, with each having a different effect on how a note is played. Some articulation marks include a slur, a phrase mark, staccato, staccatissimo, accent, sforzando, rinforzand, and legato. Each articulation is represented by a different symbol placed above or below the note (depending on its position on the staff). In this example, improvisation system 410 replaces a reserved portion in synthesized melody 428 with either a rest or an articulation symbol. Improvisation system 410 randomly selects whether to insert a rest or an articulation symbol into the reserved portion.

In an example, improvisation system 410 identifies the various chords included in input chord progression 406. For each chord, improvisation system 410 identifies one or more guide tones. Using the identified one or more guide tones, improvisation system 410 generates interpolation tones for each of the chords. Improvisation system 410 generates the interpolation tones by implementing one or more of a tone based interpolation operation, a chromatic interpolation operation, a chord based interpolation operation, and a scale based interpolation operation. In an example, improvisation system 410 randomly selects one of the interpolation operations for execution. In another example, improvisation system 410 selects one of the interpolation operations for execution based on results of the harmonic analysis. Interpolation methods are pseudorandom, e.g., depending in part on the length of the interval (gap) between the two guide tones.

In an example, improvisation system 410 determines a total number of interpolation tones to be generated based on a time signature of input chord progression 406. For each chord in input chord progression 406, improvisation system 410 determines a number of interpolation tones for the chord. For each pair of consecutive guide tones, improvisation system 410 generates the determined number of interpolation tones for use between those guide tones.

Using guide tones 426, improvisation system 410 generates synthesized music that reflects the harmonic analysis of input chord progression 406. As previously described, improvisation system 410 uses guide tones 426 in generating interpolation tones. As also previously described, improvisation system 410 interpolates lines through guide tones 426. In this example, improvisation system 410 interpolates the lines by choosing an interpolation method (to be described in more detail later) and following the appropriate procedure. In this example, improvisation system 410 generates a synthesized melody by combining the interpolation tones and the guide tones into a melody, e.g., in accordance with a specified order for the interpolation tones and the guide tones.

In an example, improvisation system 410 implements a library (not shown) for causing synthesized melody 428 to be played for user 404. In an example, the library may include the Java programming language and JFugue libraries. Using the JFugue libraries, improvisation system 410 may generate a JFugue string, e.g., a string of information representative of tones that is formatted in accordance with specifications for the JFugue libraries. In this example, the library converts a string of information (e.g., a JFugue string) into audible sound. In this example, the string of information that is passed to the library represents synthesized melody 428. For example, the string may include the following information: C5maj7w, which specifies various chords and notes to be played. In an example, improvisation system 410 is configured to determine a quality of synthesized melody 428, e.g., by comparing synthesized melody 428 against a set of musical rules that dictate improvisation. In this example, improvisation system 410 verifies that synthesized melody 428 possesses a predefined amount of harmonic quality (e.g., sounds good) and further verifies that synthesized melody 428 possesses a predefined amount of musical variation (e.g., a lack of repetition in the chords and tones used in synthesized melody 428). In this example, improvisation system 410 retrieves, from data repository 424, a plurality of musical rules that promote melodious musical quality. In this example, the musical rules promote melodious musical quality by specifying various criteria, including, e.g., a synthesized melody sounds good, a synthesized melody is varied relative to other synthesized melody, a synthesized melody reflects the chord changes of an input chord progression, and so forth. In this example, the musical rules include instructions for evaluating each of these criteria for a synthesized melody and for selecting attributes of a synthesized melody that may be used in evaluating these criteria.

In this example, improvisation system 410 applies the plurality of musical rules to attributes of synthesized melody 428. Improvisation system 410 determines, based on applying the musical rules, a quality level value of synthesized melody 428. For example, the musical rules may include instructions for generating an overall quality level value, e.g., based on assessment of the individual criteria. Improvisation system 410 also determines whether the quality level value of synthesized melody 428 satisfies a quality threshold value, e.g., a value indicative of a predefined amount of quality. If the quality level value satisfies the quality threshold value, improvisation system 410 causes synthesized melody 428 to be played for user 404.

If the quality level value fails to satisfy the quality threshold value, improvisation system 410 generates another synthesized melody, e.g., by selecting different moving tones and/or to harmonic attributes. In this example, improvisation system 410 selects guide tones that differ from guide tones 426, e.g., based on selection of different moving tones. Using the different guide tones, improvisation system 410 generates a new synthesized melody that differs from synthesized melody 428. Using the above-described techniques, improvisation system 410 determines if the quality level value of the new synthesized melody satisfies the quality threshold value.

In still another example, the quality level value may be a value based on one or more of the individual criteria. For example, a quality level value may be indicative of an amount of repetition in a synthesized melody. In this example, the quality threshold value is indicative of an amount of repetition that may occur in a chord progression.

In an example, jazz music is appropriate for use as an input chord progression in generating a synthesized melody. Various attributes of jazz music make jazz music appropriate. Jazz music is inherently an improvisational style; a standard jazz recording will play through the (short) melody once, maybe twice, and then have the performers improvise solos for the vast majority of the remaining time.

Figure 5:
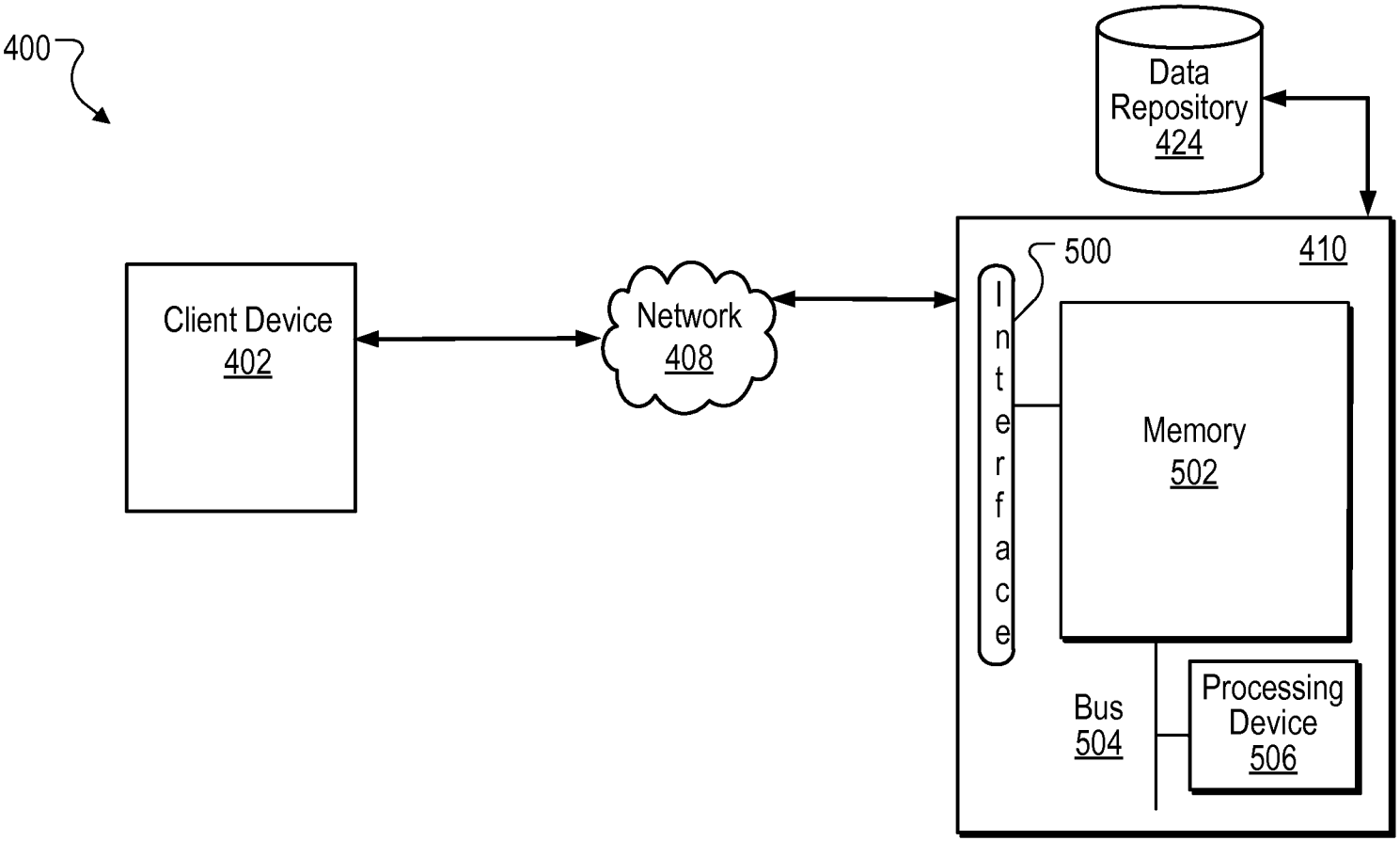
FIG. 5 is a block diagram showing examples of components of a network environment for generating a synthesized melody.

FIG. 5 is a block diagram showing examples of components of network environment 400 for generating a synthesized melody. Client device 402 can be any sort of computing device capable of taking input from a user and communicating over network 408 with improvisation system 410 and/or with other client devices. For example, client device 402 can be a mobile device, a desktop computer, a laptop, a cell phone, a personal digital assistant ("PDA"), a server, an embedded computing system, and so forth.

Improvisation system 410 can be any of a variety of computing devices capable of receiving data, such as a server, a distributed computing system, a desktop computer, a laptop, a cell phone, a rack-mounted server, and so forth. Improvisation system 410 may be a single server or a group of servers that are at a same location or at different locations.

Improvisation system 410 can receive data from client device 402 via input/output ("I/O") interface 500. I/O interface 500 can be any type of interface capable of receiving data over a network, such as an Ethernet interface, a wireless networking interface, a fiber-optic networking interface, a modem, and so forth. Improvisation system 410 also includes a processing device 506 and memory 502. A bus system 504, including, for example, a data bus and a motherboard, can be used to establish and to control data communication between the components of improvisation system 410.

The illustrated processing device 506 may include one or more microprocessors. Generally, processing device 506 may include any appropriate processor and/or logic that is capable of receiving and storing data, and of communicating over a network (not shown). Memory 502 can include a hard drive and a random access memory storage device, such as a dynamic random access memory, or other types of non-transitory machine-readable storage devices. Memory 502 stores computer programs (not shown) that are executable by processing device 506 to perform the techniques described herein.

Figure 6:
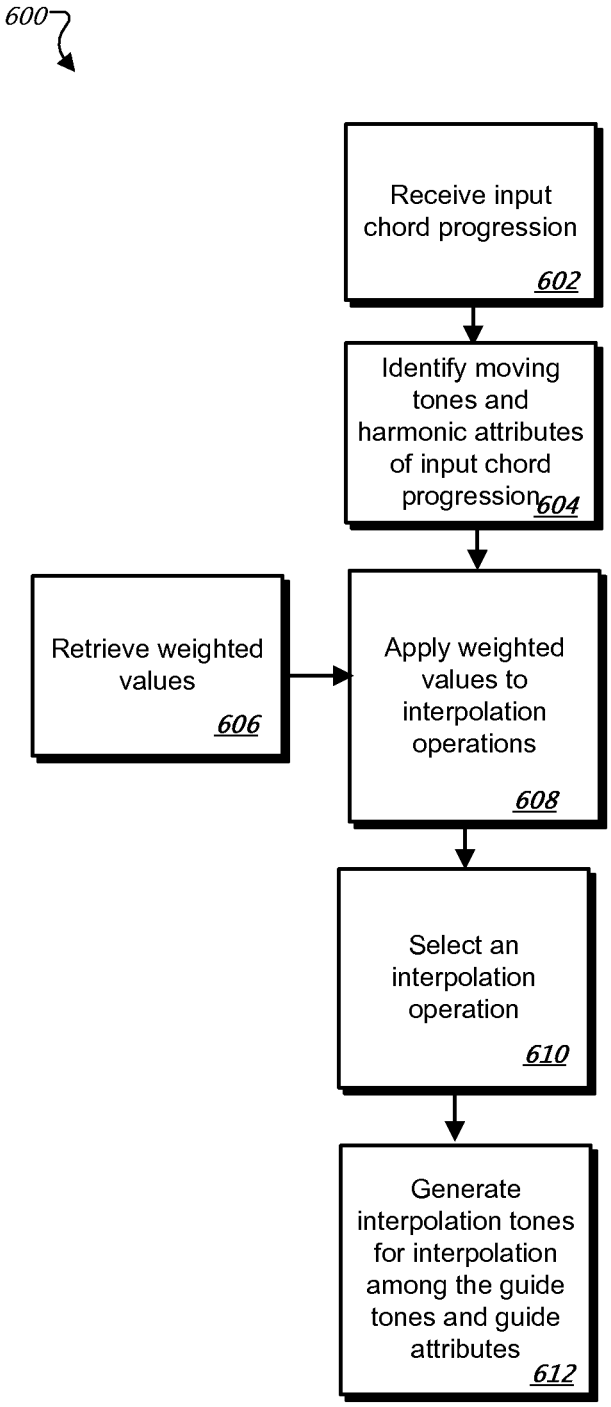
FIG. 6 is a flowchart showing an example of a process for generating a synthesized melody.

FIG. 6 is a flowchart showing an example of process 600 for generating a synthesized melody, including, e.g., synthesized melody 428. In operation, improvisation system 410 receives (602) an input chord progression. For example, improvisation system 410 receives input chord progression 406 from client device 402. In this example, improvisation system 410 identifies (604) moving tones and harmonic attributes in input chord progression 406. In the example of FIG. 6, improvisation system 410 retrieves (606) weighted values from data repository 424, e.g., by retrieving weighting rules 432. Improvisation system 410 applies (608) the weighted values to various interpolation operations.

Based on application of the weighted values, improvisation system 410 selects (610) an interpolation operation. Improvisation system 410 also selects one or more of the moving tones as guide tones and one or more of the harmonic attributes as guide attributes, using the above-described techniques. Using the guide tones and the selected interpolation operation, improvisation system 410 generates (612) interpolation tones for interpolation among the guide tones and one or more the guide attributes. In this example, improvisation system 410 generates synthesized melody 428 through combining (e.g., interpolating) the interpolation tones, the guide tones and one or more the guide attributes.

Figure 7:
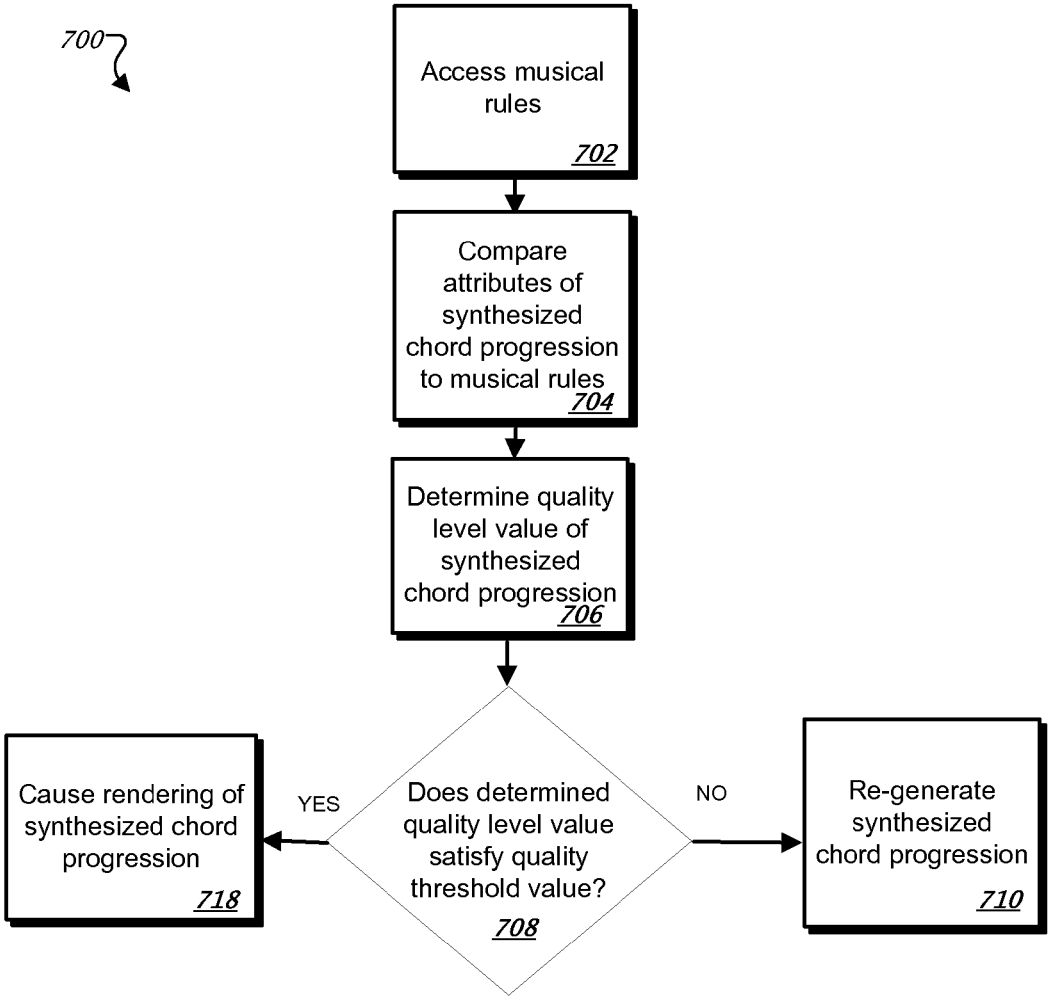
FIG. 7 is a flowchart showing an example of a process for verifying the quality of a synthesized melody.

FIG. 7 is a flowchart showing an example of a process 700 for verifying the quality of a synthesized melody. In operation, improvisation system 410 accesses (702), from data repository 424, musical rules. Improvisation system 410 also compares (704) attributes of the synthesized melody to the musical rules. Based on the comparison, improvisation system 410 determines (706) a quality level value of the synthesized melody. In this example, improvisation system 410 determines (708) whether the quality level value satisfies the quality threshold value. In an example, improvisation system 410 determines that the quality level value fails to satisfy the quality threshold value. In this example, improvisation system 410 re-generates (710) the synthesized melody, e.g., by varying the weighted values applied to the interpolation operations and/or by selecting different moving tones and/or the harmonic attributes. In another example, improvisation system 410 determines that the quality level value satisfies the quality threshold value. In this example, improvisation system 410 causes (718) a rendering (e.g., a playing) of the synthesized melody for a user of improvisation system 410.

Using the techniques described herein, a system is configured to perform harmonic analysis on an input chord progression. Based on results of the harmonic analysis, the system is further configured to identify moving tones and harmonic attributes of the input chord progression. From the moving tones, the system identifies one or more guide tones. The system generates a synthesized melody by interpolating tones among the guide tones and by using one or more of the harmonic attributes to select the interpolation tones.

Embodiments can be implemented in digital electronic circuitry, or in computer hardware, firmware, software, or in combinations thereof. An apparatus can be implemented in a computer program product tangibly embodied or stored in a machine-readable storage device for execution by a programmable processor; and method actions can be performed by a programmable processor executing a program of instructions to perform functions by operating on input data and generating output. The embodiments described herein, and other embodiments of the invention, can be implemented advantageously in one or more computer programs that are executable on a programmable system including at least one programmable processor coupled to receive data and instructions from, and to transmit data and instructions to, a data storage system, at least one input device, and at least one output device. Each computer program can be implemented in a high-level procedural or object oriented programming language, or in assembly or machine language if desired; and in any case, the language can be a compiled or interpreted language.

Processors suitable for the execution of a computer program include, by way of example, both general and special purpose microprocessors, and any one or more processors of any kind of digital computer. Generally, a processor will receive instructions and data from a read-only memory or a random-access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. Computer readable media for embodying computer program instructions and data include all forms of non-volatile memory, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in special purpose logic circuitry. Any of the foregoing can be supplemented by, or incorporated in, ASICs (application-specific integrated circuits).

To provide for interaction with a user, embodiments can be implemented on a computer having a display device, e.g., a LCD (liquid crystal display) monitor, for displaying data to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Embodiments can be implemented in a computing system that includes a back end component, e.g., as a data server, or that includes a middleware component, e.g., an application server, or that includes a front end component, e.g., a client computer having a graphical user interface or a Web browser through which a user can interact with an implementation of embodiments, or any combination of such back end, middleware, or front end components. The components of the system can be interconnected by any form or medium of digital data communication, e.g., a communication network. Examples of communication networks include a local area network (LAN) and a wide area network (WAN), e.g., the Internet.

The system and method or parts thereof may use the "World Wide Web" (Web or WWW), which is that collection of servers on the Internet that utilize the Hypertext Transfer Protocol (HTTP). HTTP is a known application protocol that provides users access to resources, which may be data in different formats such as text, graphics, images, sound, video, Hypertext Markup Language (HTML), as well as programs. Upon specification of a link by the user, the client computer makes a TCP/IP request to a Web server and receives data, which may be another Web page that is formatted according to HTML. Users can also access other pages on the same or other servers by following instructions on the screen, entering certain data, or clicking on selected icons. It should also be noted that any type of selection device known to those skilled in the art, such as check boxes, drop-down boxes, and the like, may be used for embodiments using web pages to allow a user to select options for a given component. Servers run on a variety of platforms, including UNIX machines, although other platforms, such as Windows 2000/2003, Windows NT, Sun, Linux, and Macintosh may also be used. Computer users can view data available on servers or networks on the Web through the use of browsing software, such as Firefox, Netscape Navigator, Microsoft Internet Explorer, or Mosaic browsers. The computing system can include clients and servers. A client and server are generally remote from each other and typically interact through a communication network. The relationship of client and server arises by virtue of computer programs running on the respective computers and having a client-server relationship to each other.

Other embodiments are within the scope and spirit of the description claims. Additionally, due to the nature of software, functions described above can be implemented using software, hardware, firmware, hardwiring, or combinations of any of these. Features implementing functions may also be physically located at various positions, including being distributed such that portions of functions are implemented at different physical locations. The use of the term "a" herein and throughout the application is not used in a limiting manner and therefore is not meant to exclude a multiple meaning or a "one or more" meaning for the term "a." Additionally, to the extent priority is claimed to a provisional patent application, it should be understood that the provisional patent application is not limiting but includes examples of how the techniques described herein may be implemented.

A number of exemplary embodiments of the invention have been described. Nevertheless, it will be understood by one of ordinary skill in the art that various modifications may be made without departing from the spirit and scope of the invention.

What is claimed is:

1. A method performed by one or more processing devices, comprising:

receiving, by one or more computer systems, information indicative of an input chord progression, with the input chord progression comprising a plurality of chords;

identifying, by the one or more computer systems, chord changes in the plurality of chords;

identifying, by the one or more computer systems based on the chord changes, moving tones in the input chord progression;

selecting, by the one or more computer systems from the moving tones, guide tones that guide formation of a synthesized variation of the input chord progression;

generating, by the one or more computer systems based on the guide tones, an outline of a harmony for a synthesized melody;

wherein the outline comprises (i) the guide tones, and (ii) areas between the guide tones, with the areas between the guide tones being designated for insertion of interpolation tones;

generating, by the one or more computer systems based on the selected guide tones and one or more interpolation operations, the interpolation tones for interpolation among the guide tones;

populating the areas in the outline that are between the guide tones with the interpolation tones to interpolate the interpolation tones among the guide tones in the outline; and generating, based on interpolation of the interpolation tones with the guide tones, the synthesized melody.

2. The method of claim 1, wherein generating the interpolation tones for interpolation among the guide tones comprises:

generating, for a particular chord in the input chord progression, one or more interpolation tones for the particular chord in the input chord progression;

wherein the one or more interpolation tones generated for the particular chord are consonant with original tones included the particular chord.

3. The method of claim 1, further comprising:

identifying harmonic attributes of the chord progression;

wherein selecting, from the moving tones, the guide tones comprises:

selecting, from the moving tones, the guide tones; and selecting, from the harmonic attributes, guide attributes; and wherein generating, based on the interpolation of the interpolation tones with the guide tones, the synthesized melody comprises:

generating, based on interpolation of the interpolation tones with the guide tones and based on one or more of the guide attributes, the synthesized melody.

4. The method of claim 3, wherein the harmonic attributes comprise one or more of scale degrees and types of the plurality of chords in the chord progression and detected tension in the plurality of chords in the chord progression.

5. The method of claim 1, wherein the input chord progression is for jazz music.

6. The method of claim 1, further comprising:

applying one or more interpolation operations to the guide tones;

wherein generating, based on the selected guide tones, the interpolation tones for interpolation among the guide tones comprises:

generating, based on applying the one or more interpolation operations to the guide tones, the interpolation tones for interpolation among the guide tones.

7. The method of claim 6, wherein the one or more interpolation operations comprise one or more of a tone based interpolation operation, a harmonic based interpolation operation, a chord based interpolation operation, and a scale based interpolation operation.

8. The method of claim 1, further comprising:

retrieving a plurality of musical rules that promote melodious musical quality;

applying the plurality of musical rules to attributes of the synthesized melody;

determining, based on applying, a quality level value of the synthesized melody; and determining that the quality level value of the synthesized melody satisfies a quality threshold value.

9. One or more machine-readable media storing instructions that are executable by one or more processing devices to perform operations comprising:

receiving information indicative of an input chord progression, with the input chord progression comprising a plurality of chords;

identifying chord changes in the plurality of chords;

identifying, based on the chord changes, moving tones in the input chord progression;

selecting, from the moving tones, guide tones that guide formation of a synthesized variation of the input chord progression;

generating, based on the guide tones, an outline of a harmony for a synthesized melody;

wherein the outline comprises (i) the guide tones, and (ii) areas between the guide tones, with the areas between the guide tones being designated for insertion of interpolation tones;

generating, based on the selected guide tones and one or more interpolation operations, the interpolation tones for interpolation among the guide tones;

populating the areas in the outline that are between the guide tones with the interpolation tones to interpolate the interpolation tones among the guide tones in the outline; and generating, based on interpolation of the interpolation tones with the guide tones, the synthesized melody.

10. The one or more machine-readable media of claim 9, wherein generating the interpolation tones for interpolation among the guide tones comprises:

generating, for a particular chord in the input chord progression, one or more interpolation tones for the particular chord in the input chord progression; and wherein the one or more interpolation tones generated for the particular chord are consonant with original tones included the particular chord.

11. The one or more machine-readable media of claim 9, wherein the operations further comprise:

identifying harmonic attributes of the chord progression;

wherein selecting, from the moving tones, the guide tones comprises:

selecting, from the moving tones, the guide tones; and selecting, from the harmonic attributes, guide attributes; and wherein generating, based on the interpolation of the interpolation tones with the guide tones, the synthesized melody comprises:

generating, based on interpolation of the interpolation tones with the guide tones and based on one or more of the guide attributes, the synthesized melody.

12. The one or more machine-readable media of claim 11, wherein the harmonic attributes comprise one or more of scale degrees and types of the plurality of chords in the chord progression and detected tension in the plurality of chords in the chord progression.

13. The one or more machine-readable media of claim 9, wherein the input chord progression is for jazz music.

14. The one or more machine-readable media of claim 9, wherein the operations further comprise applying one or more interpolation operations to the guide tones;

wherein generating, based on the selected guide tones, the interpolation tones for interpolation among the guide tones comprises:

generating, based on applying the one or more interpolation operations to the guide tones, the interpolation tones for interpolation among the guide tones.

15. An electronic system comprising:

one or more processing devices; and one or more machine-readable media storing instructions that are executable by the one or more processing devices to perform operations comprising:

receiving information indicative of an input chord progression, with the input chord progression comprising a plurality of chords;

identifying chord changes in the plurality of chords;

identifying, based on the chord changes, moving tones in the input chord progression;

selecting, from the moving tones, guide tones that guide formation of a synthesized variation of the input chord progression;

generating, based on the guide tones, an outline of a harmony for a synthesized melody;

wherein the outline comprises (i) the guide tones, and (ii) areas between the guide tones, with the areas between the guide tones being designated for insertion of interpolation tones;

generating, based on the selected guide tones and one or more interpolation operations, the interpolation tones for interpolation among the guide tones;

populating the areas in the outline that are between the guide tones with the interpolation tones to interpolate the interpolation tones among the guide tones in the outline; and generating, based on interpolation of the interpolation tones with the guide tones, the synthesized melody.

16. The electronic system of claim 15, wherein generating the interpolation tones for interpolation among the guide tones comprises:

generating, for a particular chord in the input chord progression, one or more interpolation tones for the particular chord in the input chord progression; and wherein the one or more interpolation tones generated for the particular chord are consonant with original tones included the particular chord.

17. The electronic system of claim 15, wherein the operations further comprise:

identifying harmonic attributes of the chord progression;

wherein selecting, from the moving tones, the guide tones comprises:

selecting, from the moving tones, the guide tones; and selecting, from the harmonic attributes, guide attributes; and wherein generating, based on the interpolation of the interpolation tones with the guide tones, the synthesized melody comprises:

generating, based on interpolation of the interpolation tones with the guide tones and based on one or more of the guide attributes, the synthesized melody.

18. The electronic system of claim 17, wherein the harmonic attributes comprise one or more of scale degrees and types of the plurality of chords in the chord progression and detected tension in the plurality of chords in the chord progression.

19. The electronic system of claim 15, wherein the input chord progression is for jazz music.

20. The electronic system of claim 15, wherein the operations further comprise applying one or more interpolation operations to the guide tones;

wherein generating, based on the selected guide tones, the interpolation tones for interpolation among the guide tones comprises:

generating, based on applying the one or more interpolation operations to the guide tones, the interpolation tones for interpolation among the guide tones.

* * * * *